United States Patent [19]

McKeefery et al.

[11] Patent Number: 5,074,821

[45] Date of Patent: Dec. 24, 1991

[54] CHARACTER ANIMATION METHOD AND APPARATUS

[75] Inventors: James McKeefery, Milpitas; James Sachs, Menlo Park; James Fan, San Jose; Ming Liang, Fremont, all of Calif.

[73] Assignee: Worlds of Wonder, Inc., Fremont, Calif.

[21] Appl. No.: 467,252

[22] Filed: Jan. 18, 1990

[51] Int. Cl.[5] ..... A63H 3/28

[52] U.S. Cl. ..... 446/299; 446/301; 40/416

[58] Field of Search ..... 446/301, 300, 299, 298, 446/303; 40/416, 414, 457; 369/64, 70

[56] References Cited

U.S. PATENT DOCUMENTS

| | | | |
|---|---|---|---|
| 3,287,849 | 11/1966 | Weiss | 446/299 |
| 4,139,968 | 2/1979 | Milner | 446/301 |
| 4,177,589 | 12/1979 | Villa | 40/457 |
| 4,665,640 | 5/1987 | Forsse et al. | 446/301 X |
| 4,775,352 | 10/1988 | Curran et al. | 446/301 |
| 4,805,328 | 2/1989 | Mirahem | 446/301 X |
| 4,864,607 | 9/1989 | Mitamura et al. | 446/301 X |

*Primary Examiner*—Mickey Yu

*Attorney, Agent, or Firm*—Blakely, Sokoloff, Taylor & Zafman

[57] ABSTRACT

A voice track is recorded on one track of a dual track recording device, typically a tape recorder. On a second track of the recorder an animation signal is recorded characterized by the signal having a frequency at any given time indicative of the then currently desired animation condition. A character is provided having a tape playback unit therein for playing back such pre-recorded dual track tapes, the character having an amplifier and speaker for reproducing the audio information, and a servo motor having a drive system for driving the character mouth elements and eyes with the desired animation, the drive system having a feedback device thereon for providing a feedback signal to the servo motor control. The electronics in the character which is responsive to the animation control signal provided by the playback unit to provide the servo motor drive signal effectively updates the servo motor drive signal on each cycle of the animation control signal received from the playback unit.

6 Claims, 3 Drawing Sheets

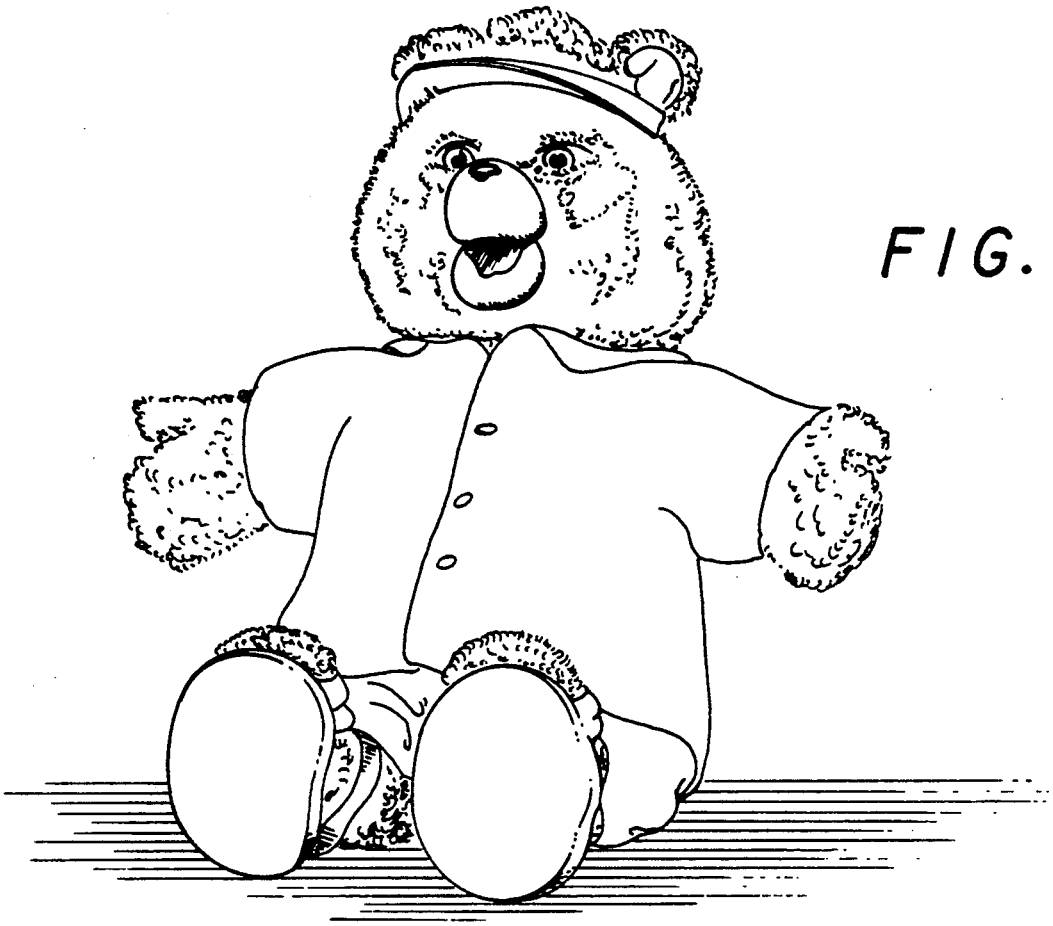
FIG. 1
FIG. 2
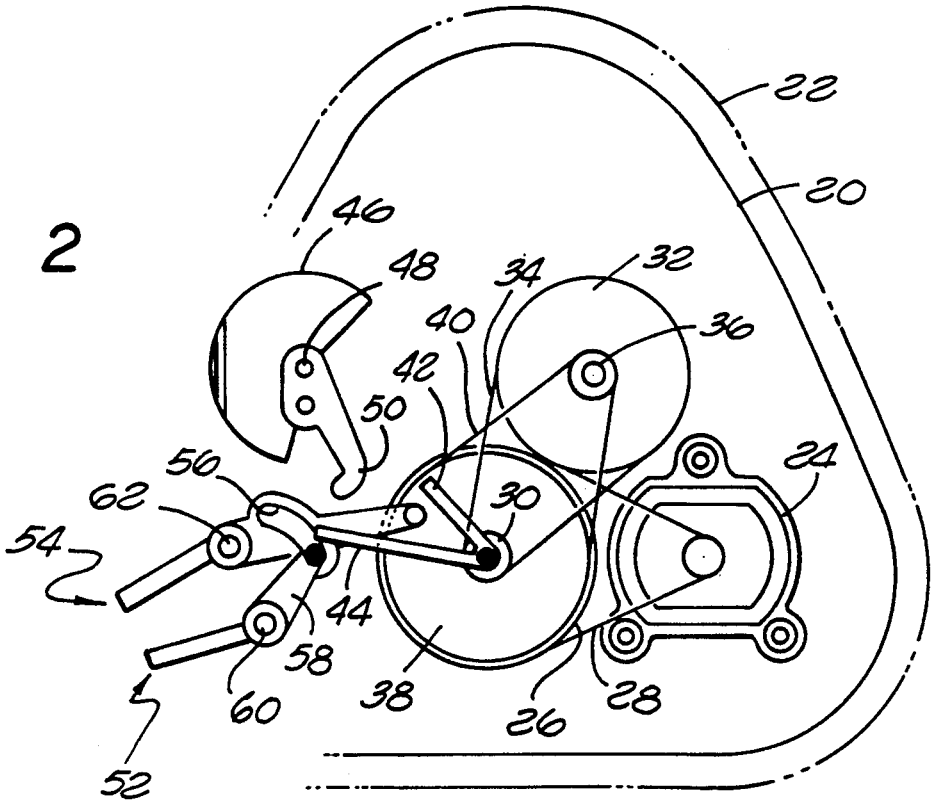

CHARACTER ANIMATION METHOD AND APPARATUS

BACKGROUND OF THE INVENTION

1. Field of the Invention

The present invention relates to the field of animated toy characters.

2. Prior Art

In very recent years, animated toy characters have been manufactured and sold in accordance with U.S. Pat. No. 4,665,640. Such characters include a dual track playback unit, accessible through the back of the character, for receipt and playing of a dual track tape cassette having a voice signal recorded on one track thereof, and an animation control signal recorded on a second track thereof. The voice track of course is in general merely played back through a speaker in the body of the character. The animation control signal as recorded is a pulsed width modulated multi-channel signal having a variable frame time, recorded on the tape without further modulation thereof. In these characters, one channel is used for the animation of the mouth in synchronism with the voice track, and a second channel is used for animation of the eyes, with additional channels being available for other uses.

On playback, the animation control track is demodulated and the demodulated signals used to proportionally control the servo motors controlling the animated features. The proportional control coupled with the position feedback on each servo system provides a smooth, fully controllable motion for each of the animated elements. However, the pulse width modulation signal has a signal dependent frame time, making the repetition rate of the demodulated signal longer than may be desired. Also, the signal dependent frame time makes the editing of the animation control information during the creation of a master tape difficult, as one may not merely re-tailor a segment of the animation or remove and replace a segment and have the new information fit within the exact same playback time as the original segment before modification or replacement. Finally, the pulse width demodulation and the multiple servo systems in the character to animate multiple features are more expensive than desired for many toys.

Various other animation techniques have been used in the prior art. By way of example, to eliminate the duplication of servo systems within the animated character, a single animation channel has been used to control a single servo system which animated the mouth of the character during one part of its travel and animated the eyes during another part of its travel.

In U.S. Pat. No. 4,177,589, the animation control signals are derived directly from the single voice track. Such an arrangement has certain advantages in that the voice track need not even be prerecorded, but rather can be an impromptu voice signal provided through a hidden microphone. It has the disadvantage however, of not providing the flexibility of tailoring the animation, and may provide the appearance of mouth movements, etc., lagging the sound provided.

In U.S. Pat. No. 3,912,794, a dual track tape is provided with an audio signal on one track and with a pulse train as an animation control signal on the second track. On playback, the pulse train is reproduced and fed to a frequency selector which detects the frequency of each pulse by an appropriate band pass network. The detected signal is amplified and transformed into a DC level control signal which is then applied to the appropriate input of a multiple self feeding relay inverter. This in turn controls programming motors operating various solenoid switches through cam disks driven by the motors to provide animation through the solenoid operation. As such, the system does not provide proportional control, and is quite mechanically and electronically complex as a result of the requirement of multiple band pass filters, motors, cam actuated switches, solenoids, and the like. Still other animation systems are disclosed in U.S. Pat. Nos. 3,287,849 and 4,139,968. None of these other systems however provide the flexibility and enchanting animation for animated characters for young children that the first system described hereabove provides because of the proportional control through an animation control signal independent of but synchronized to the voice signal to provide the animation desired. In that regard, one of the purposes of the present invention is to maintain the performance and flexibility of that animation system, while at the same time simplifying both the master tape creating process by simplifying the editing of the animation control signal, and at the same time reducing the cost of the animated character by reducing the complexity of the electronics and electromechanical control therein, all without effecting the animated characters ability to charm and captivate the youngest of children and parents alike.

BRIEF DESCRIPTION OF THE DRAWINGS

FIG. 1 is a view of a typical plush toy incorporating the present invention.

FIG. 2 is a schematic cross-section taken through the head of the plush toy of FIG. 1.

DETAILED DESCRIPTION OF THE INVENTION

Figure 3:
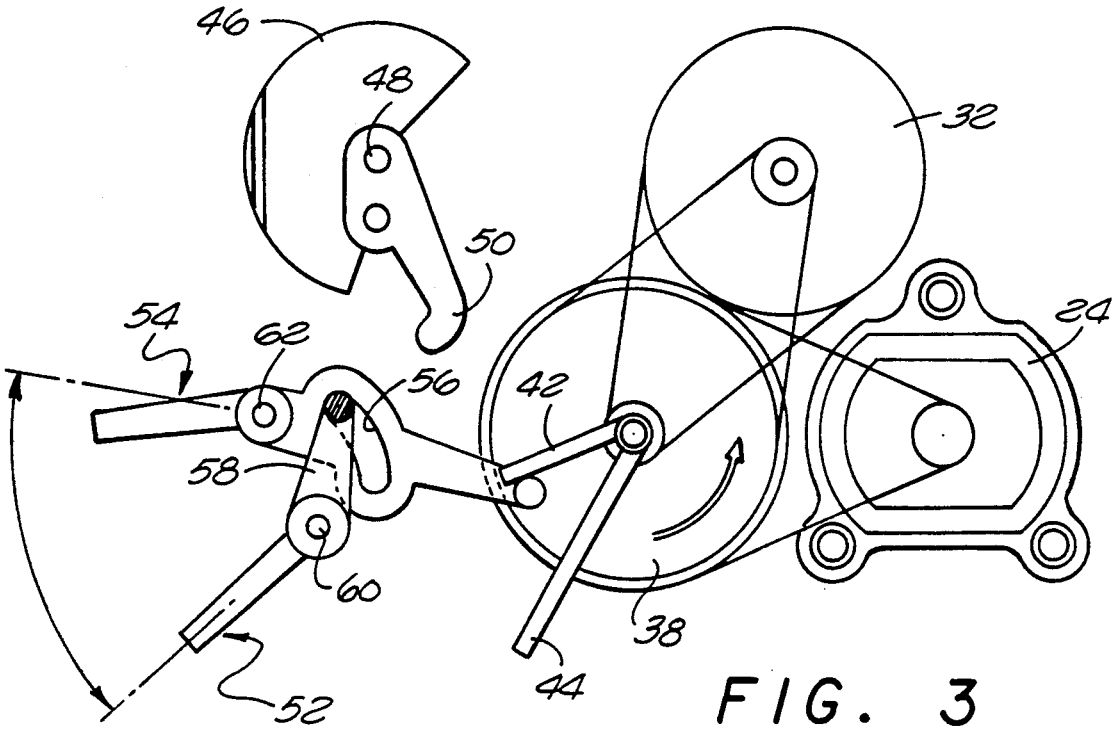
FIG. 3 is a schematic cross-section similar to that of FIG. 2 illustrating the mechanism in the fully mouth-open condition.

First referring to FIG. 1, a view of a typical character which may be animated in accordance with the present invention may be seen. The character, in this case in the form of a Teddy Bear type character, contains a tape playback unit accessible through the back thereof, a hidden speaker in the chest region thereof, and a servo motor and drive system in the head assembly for animating the mouth and eyes of the character.

A schematic cross section taken through the head of the character of FIG. 1 may be seen in FIG. 2. The head is formed of a plastic skull-like structure 20 having a layer of foam 22 thereon for padding, and containing the animation mechanism for the character. In particular, a servo motor 24 drives a first pulley 26 by way of a small belt 28. Integral with pulley 26 is a small pulley 30 driving pulley 32 by way of another belt 34. Integral with pulley 32 is still another pulley 36 driving a further pulley 38 coaxial with pulleys 26 and 30, though rotationally independent thereof, through belt 40. The various pulleys provide a very substantial speed reduction, in the preferred embodiment a reduction of approximately 120 to 1, in a substantially noise free belt drive system. Further, belt tensions, materials, etc., are preferably selected so that the drive system will slip if pulley 38 is restricted from rotation while the servo motor 24 is still operating and/or pulley 38 is forced into rotation other than by the servo motor. Pulley 38 is directly connected to the shaft of a feedback potentiometer so that the feedback signal therefrom is directly indicative of the position of the pulley 38 independent of any prior or contemporaneous belt slippage in the drive system.

Integral with pulley 38 are paddle like projections 42 and 44, the function of which shall be subsequently described. Also disposed within the structure 20 are a pair of eyes 46 pivotly supported on axis 48 so as to be rotatable in unison thereabout, the eyes being spring loaded to the position shown. Coupled to the eyes is a lever 50 projecting downward and somewhat rearward which is used to rotate the eyes about axis 48 as desired. Located below the eyes are a pair of mouth actuating members, generally indicated by the numerals 52 and 54, which extend into mouth regions on an outer cover (not shown) over the structure, the outer covering defining not only the mouth and eye openings of the character, but also the other face and head features as desired. The mouth member 54 has a cam like slot 56 therein, with mouth member 52 having a rearward extension 58 having a projection thereon fitting within slot 56 so as to be guided thereby, the mouth members 52 and 54 being pivotly supported on axis 60 and 62, respectively. Finally, member 54 is spring loaded to the position shown which automatically brings member 52 to the position shown, the position of the two members corresponding to the mouth closed position.

Figure 4:
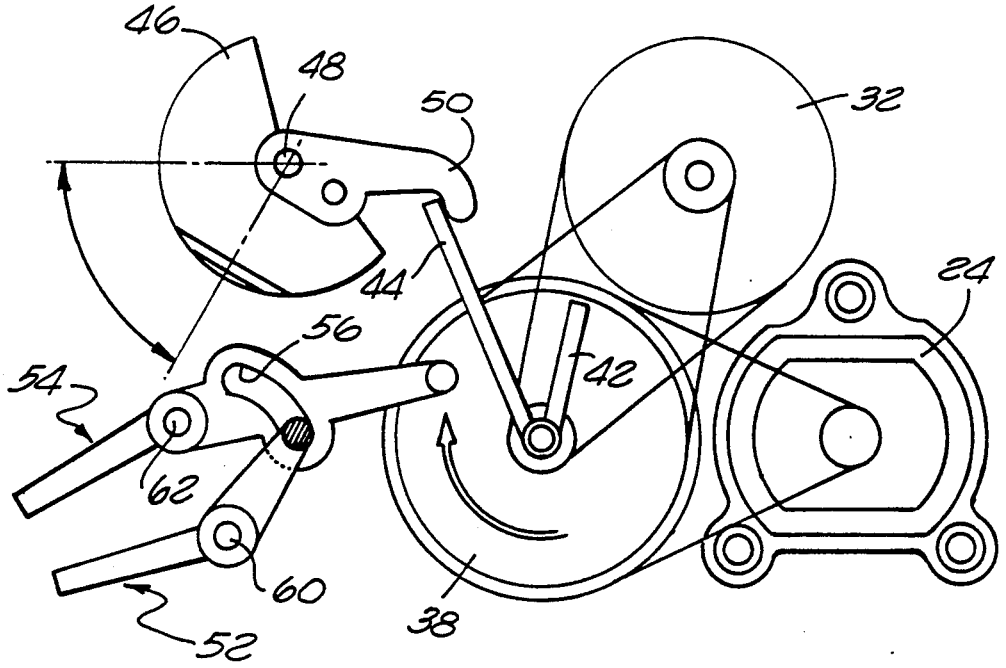
FIG. 4 is a schematic cross-section similar to that of FIG. 2 showing the mechanism in the mouth-closed, eyes down position.

Now referring to FIG. 3, the drive system is shown in the position corresponding the mouth open position. In this case, the pulley 38 has been driven counterclockwise so that paddle member 42 has engaged the rearward extending arm on mouth member 54 and moved the same to the position shown, which in turn has caused a corresponding rotation in mouth member 52. In FIG. 4 on the other hand, pulley 38 has been rotated in the opposite direction so that paddle member 44 has engaged the downward extending arm 50 of the eye assembly to rotate the same downward approximately 60 degrees, as if the eyes were closed or blinking.

It can be seem from FIGS. 2, 3 and 4 that, with the eyes looking straight ahead, the mouth may be driven from the closed position of FIG. 2 to the open position of FIG. 3, and of course to any other position therebetween. Alternatively, with the mouth closed, the eyes may be moved downward as shown in FIG. 4 or to any position between that shown in FIGS. 2 and 4, though the eyes and mouth cannot be simultaneously driven from the position shown in FIG. 2. It can be seen further in FIG. 2 that pulley 38 and of course the feedback potentiometer coupled thereto must be driven through some small but definite angle in either direction before either the eyes or the mouth actuation begins. Thus, there is one range of operation of the drive system for providing animation of the mouth, a second nonoverlapping range of operation of the drive system for eye movement, and a dead zone therebetween within which movement of the drive system will not cause either eye or mouth movement. The inability to animate both the mouth and the eyes at the same time is of little consequence, as fairly realistic appearing eye movement can be obtained even by limiting the eye movement to pauses between sentences or phrases of a song, during which no mouth animation is required.

Figure 5:
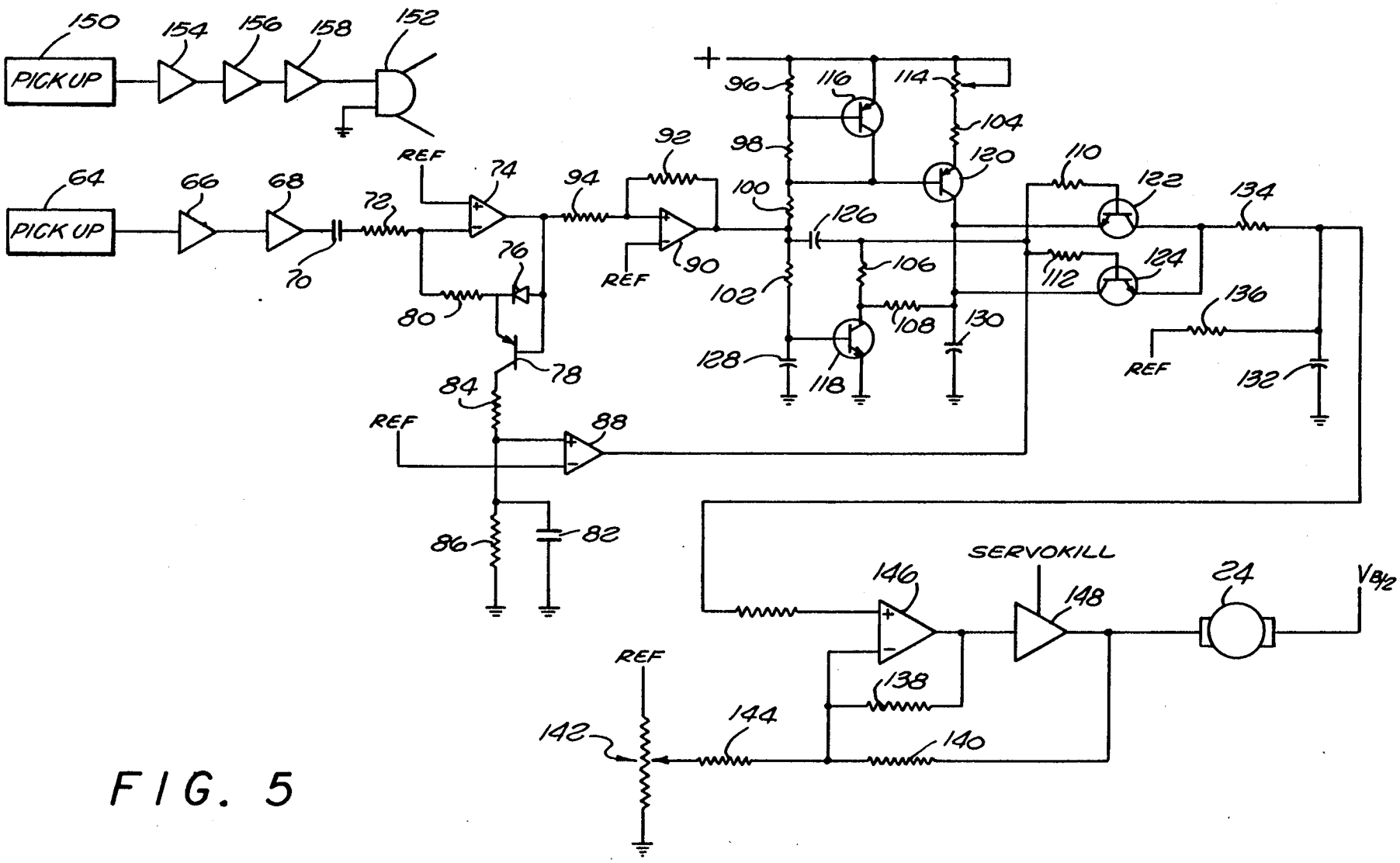
FIG. 5 is a circuit diagram for the control circuitry in the plush toy of FIG. 1.

Now referring to FIG. 5, a schematic diagram of the electronics in the character may be seen. As shown therein, and as stated hereinbefore, one channel of the dual channel pre-recorded tape and tape playback unit provides the animation control signal and the other channel provides the audio channel. Thus, as shown in the Figure, a pick-up head 64 of the playback unit provides an animation control signal which is amplified by amplifiers 66 and 68 (in the discussion to follow, for purposes of clarity, feedback circuits, frequency band limiting circuits, etc., are in general not shown unless the same provides special functions or the same relate to the understanding of the operation of the system). The output of amplifier 68 is coupled through capacitor 70 and resistor 72 to a differential amplifier 74 coupled as a limiter. In particular, the positive input of the differential amplifier is coupled to a reference voltage with the output thereof being coupled back to the inverting input of the amplifier 74 through the parallel combination of diode 76 and transistor 78 connected in series with resistor 80. The forward conduction voltage drop of diode 76, as well as the emitter base junction drop of transistor 78 is approximately 0.7 volts, so that no feedback is provided between the output of the differential amplifier 74 and the inverting input thereto if the difference in the output and the inverting input is less than approximately 0.7 volts. Within this limited range, the apparent gain of the differential amplifier is essentially the open loop gain thereof. When the output of the amplifier exceeds the inverting input thereto, diode 76 will be conducting, providing feedback through resistor 80 to then limit the gain to a relatively nominal value. Similarly, if the output of differential amplifier 74 is more than 0.7 volts lower than the inverting input thereto, transistor 78 will be turned on, with the emitter base junction of the transistor conducting sufficiently to provide feedback through the resistor 80, much like hereinbefore described with respect to the diode 76, again reducing the gain of the amplifier to a relatively nominal value. Thus, the output of the limiter 74 is a substantially symmetrical "square" wave having somewhat rounded tops and having the frequency corresponding to a frequency of the signal recorded on the animation track part of the dual track tape currently being played by the tape playback unit in the character. In general, the circuit shown will hold the differential input to amplifier 74 substantially at zero, so that the inverting input of the amplifier 74 will in general be equal to the reference voltage provided to the non-inverting input thereto.

From the foregoing description, it may be seen that provided there is an adequate animation signal being picked up by pickup 64, transistor 78 will be conducting approximately 50 percent of the time, charging capacitor 82 through resistor 84. If on the other hand the signal being interpreted as the animation signal is inadequate, transistor 78 will either remain off or have such a low duty cycle as to allow capacitor 82 to discharge through resistor 86, resistor 86 being substantially larger than resistor 84 so as to not effect the charging of the capacitor during the normal operation of the transistor. Thus, when there is an adequate animation signal, the differential input to comparator 88 is positive. In the particular comparator used, this gives an open collector or floating output. If on the other hand the animation signal is inadequate, capacitor 82 will discharge through resistor 86 to a voltage lower than the reference voltage provided to the comparator 88, thereby driving the output of the comparator low (the various reference voltages referred to herein may be different reference voltages as appropriate for each part of the specific circuitry used). Thus, during normal operation of the system, the output of the differential amplifier 88 will be floating so long as the animation signal received is of adequate amplitude to appropriately provide animation control.

The output of the limiter 74 is also provided to comparator 90 provided with positive feedback through the combination of resistors 92 and 94. This comparator is of the same type as comparator 88, having a floating output for a positive differential input. The output of the comparator 90 is provided to a circuit comprised of resistors 96, 98, 100, 102, 104, 106, 108, 110, 112 and 134, potentiometer 114, transistors 116, 118, 120, 122 and 124, and capacitors 126, 128, 130 and 132. Among other things, resistors 96, 98 and 100 act as pull-up resistors for the output of comparator 90, so that the output of the comparator effectively is a square wave ranging substantially from ground to the positive rail at a frequency corresponding to the animation signal received from pickup head 64.

When the output of comparator 90 goes low, transistors 116 and 120 act as a current source depending upon resistor 104 and the setting of potentiometer 114. Thus capacitor 130 charges at a constant rate so long as the output of the comparator remains low. Since the square wave input to comparator 90 has a constant duty cycle of approximately 50 percent, the time period for which the output of comparator 90 will remain low will be inversely proportional to the frequency of the signal received from the pickup head 64. Thus, the voltage which will exist on capacitor 130 when the output of comparator 90 goes high will be inversely proportional to the instantaneous frequency of the animation signal recorded on the tape. When the output of comparator 90 goes high, capacitor 126 pulses transistors 122 and 124 into conduction through resistors 110 and 112 for a short period of time, transferring at least part of the voltage on capacitor 130 through one of the two transistors and resistor 134 to capacitor 132, depending upon the value of resistor 134 and the relative values of capacitors 130 and 132. This essentially provides a sample and hold circuit, updating the voltage on capacitor 132 on every cycle of the signal received from the pickup head 64, though some effective lag is provided as a result of resistor 134 and the fact that capacitor 132 is somewhat larger than capacitor 130. The transistors 122 and 124 are pulsed on only for a short period by capacitor 126, as the same is a relatively small capacitor providing base current to transistors 122 and 124 for only a short period representing a fraction of the duration of half a cycle of even the highest animation control frequency.

Also, when the output of comparator 90 goes high, capacitor 128 charges through resistors 96, 98, 100 and 102. This turns on transistor 118 later in the half cycle, discharging the small capacitor 126 to turn off transistors 122 and 124, and at the same time initiating the discharge of capacitor 130 through resistor 108 and transistor 118, substantially fully discharging the capacitor by the end of the positive half cycle of the animation control signal. When the output of comparator 90 again goes low, capacitor 128 maintains transistor 118 on for a very short period of time, forcing the voltage across capacitor 126 to substantially zero, with the transistor 118 then turning off by the discharge of capacitor 128 through resistor 102 so that capacitor 130 may again begin to charge at the constant rate as hereinbefore described. Thus, the voltage on capacitor 132 which, as shall subsequently be seen, is the voltage used to drive the servo controlling the animation features of the character, is updated on each cycle of the animation control signal, with the updating being something less than 100 percent based on the circuit parameters chosen, primarily capacitor 130 and the charging circuit therefor, resistor 104 and capacitor 132.

If the signal received from the pickup head 64 is not adequate, the output of comparator 88 will be held low, maintaining transistors 122 and 124 off at all times. In this case, capacitor 132 will charge to a voltage determined by the reference voltage applied to resistor 136, a relatively larger resistor, the reference voltage being chosen to drive the servo to a position corresponding to the mouth closed, eyes straight ahead condition illustrated in FIG. 1.

The voltage on capacitor 132 is coupled to the noninverting input of differential amplifier 146, the output of which is coupled through a power amplifier 148 to drive one lead of the servo motor 24, the other lead being coupled to the midpoint of the battery power supply. The inverting input to differential amplifier 146 is coupled to the output thereof through feedback resistor 138 and to the output of power amplifier 148 through feedback resistor 140, as well as to the feedback potentiometer generally indicated by the numeral 142 providing, as stated before, direct feedback of the position of the pulley 38 through resistor 144.

Also shown in FIG. 5 is the electronics for the audio track comprising the second pickup head 150 providing the audio signal to the speaker 152 through amplifiers 154 and 156 and power amplifier 158. These circuits may be conventional circuits and accordingly are not described in further detail herein.

In the preferred embodiment the power supply comprises four batteries in series with a center tap taken to provide the $V_B/2$ voltage for the servo motor 24 (see FIG. 5). In addition, the power supply is provided with three switches, a main on/off switch so that the system may be turned on and off as desired when the tape is in place, a tape engage switch on the tape playback unit which will prevent the same from operating unless the tape cassette is properly loaded and a cassette door is closed, and a third switch for sensing the end of the tape and turning the system off in response thereto. In the preferred embodiment, this last switch comprises contacts or feelers which sense a conductor on the tape trailer to trip a bistable circuit to shut off the power to the system at the end of the tape even if the main on/off switch remains on. This bistable circuit is designed to draw substantially no power when off, so as to prevent battery drain in such condition. The main in is a momentary contact switch, itself tripping a bistable circuit for the on and off control.

In general, the program recorded on each tape is preferably formatted so that the character completes whatever it is doing by the end of the tape and is silent, with the corresponding animation position being in the dead zone with the eyes looking straight ahead and with the mouth closed. If on the other hand the main on/off switch is tripped off midtape, it is preferred to have the character stop with the mouth and eye positions corresponding to those last commanded by the animation control signal so that the character will be able to start right from where it left off when the on/off switch is again tripped on. In either event however, in order to avoid having the animation control system drive the animated element to a random or undesired position as the power supply voltage declines and various circuits become inaccurate or inoperative, a SERVOKILL signal is provided by the power supply to amplifier 148 to immediately disable the amplifier to prevent this from happening. Details of the circuit used for the power supply are not further presented herein as the same are not required for the understanding of the invention.

The use of a dual track playback unit, preferably a cassette tape playback unit for playing back cassette tapes having recorded on one track thereof an audio signal, and on the other track thereof, an animation control signal synchronized to the audio signal and having a frequency at any given time indicative of the then currently desired animation condition to control the mouth of the animated character in at least one additional animated element such as the eyes as in the preferred embodiment herein is particularly advantageous, as the electronics required to utilize such signals in each character is relatively inexpensive, particularly if reduced to a custom integrated circuit. Such a signal is also relatively easy to generate and edit, the edit function being particularly useful in the creation of master tapes from which the tapes for sale with the characters will be produced. In particular, after the voice track has been completed, one might create a rough animation control track by having one familiar with the sound track manually control the animation in synchronism with the sound track, such as by way of example, by providing an input to the non-inverting input of amplifier 146 (FIG. 5) by control of a potentiometer connected to a reference voltage, and by digitizing and storing the control signal in a computer at a relatively high rate. Now with the animation control signal in digital form, the same may be played back through a digital to analog converter in synchronism of the sound track directly, locally shifted in time, increased, decreased, sections cut out and regenerated, etc., until the final desired animation synchronized with the sound track is achieved. Thereafter, the digital data may be used to generate the animation control signal for recording in final form such as by way of example, by directly synthesizing the desired signal from the digital data through a digital analog converter and appropriate high frequency filter, or by directly converting the digital data to analog through a digital to analog converter and using that signal to control a voltage controled oscillator.

There has been described herein a new and unique character animation method and apparatus which animates more than one character feature in synchronism with an audio track, which is relatively inexpensive to manufacture, and for which a plurality of different control tapes may be easily and accurately created therefor. While the preferred embodiment of the present invention has been disclosed and described herein, it will be understood by those skilled in the art that various changes in form and detail may be made therein without departing from the spirit and scope of the invention.

We claim:

1. An animated character comprising:

body means defining at least part of a character outline having at least one moveable mouth element and second element to be animated;

a dual track tape playback means within said body means for playing a dual track tape having recorded on a first track thereof an audio signal and on a second track thereof an animation control signal characterized by having an instantaneous frequency indicative of the currently desired animation condition, wherein said playback means provides first and second signals responsive to the audio signal and the animation control signal, respectively;

a servo motor responsive to a servo motor drive signal, wherein said servo motor engages a drive means cooperatively disposed with respect to said at least one moveable mouth element and said second element to be animated and having a predetermined operating range, said drive means operative over a first part of its operating range to vary the position of said at least one moveable mouth element responsive to the movement of said drive means and operative over a second part of its operating range to vary the position of said second element to be animated responsive to the movement of said drive means, said first and second parts of the operating range of said drive means being at least in part different parts of the operating range of said drive means;

feedback means coupled to said drive means for providing a feedback signal responsive to the instantaneous position of said drive means;

amplifier means and speaker means for amplifying and converting said first signal to sound;

means responsive to said second signal for providing an analog control signal responsive to said second signal, including amplifying means for providing said servo drive signal to said servo motor responsive to the different between said animation control signal and said feedback signal.

2. The animated character of claim 1 wherein said means responsive to said second signal for providing an analog control signal responsive to said second signal is a means for providing an analog control signal which is updated on each cycle of said second signal.

3. The animated character of claim 1 wherein said first part of the operating range of said drive means and said second part of the operating range of said drive means are independent parts of the operating range of said drive means separated by a dead zone, whereby movement of said drive means to and within said dead zone will bring said at least one moveable mouth element and said second element to be animated to predetermined positions, control of said drive means in said first part of the operating range of said drive means will cause associated movement of said at least one moveable mouth element without movement of said second element to be animated, and control of said drive means in said second part of the operating range of said drive means will cause associated movement of said second element to be animated without movement of said at least one moveable mouth element.

4. The animated character of claim 1 wherein said servo motor and said drive means are coupled through a slippable friction drive, whereby said friction drive may slip upon a predetermined resistance to movement of either said at least one moveable mouth element or said second element to be animated, and wherein said feedback means is directly connected to said drive means for providing a feedback signal responsive to the instantaneous position of said drive means irrespective of slippage of said friction drive.

5. The animated character of claim 4 wherein said slippable friction drive is a belt drive.

6. The animated character of claim 1 wherein said animation control signal ranges in frequency from approximately 1 Khz to approximately 3 Khz.

* * * * *